United States Patent [19]

Loebs et al.

[11] 3,937,268

[45] Feb. 10, 1976

[54] METHOD FOR BONDING A BRONZE BUSHING ON A METALLIC MEMBER

[75] Inventors: Richard G. Loebs, Peoria; Richard C. Ostrowski, Dunlap, both of Ill.

[73] Assignee: Caterpillar Tractor Co., Peoria, Ill.

[22] Filed: Aug. 5, 1974

[21] Appl. No.: 494,970

[52] U.S. Cl. ..... 164/66; 164/80; 164/98; 164/DIG. 2

[51] Int. Cl.[2] ..... B22D 21/02; B22D 23/06; B22D 19/08

[58] Field of Search ..... 249/105, 108; 164/DIG. 2, 164/66, 80, 98; 228/257

[56] References Cited

UNITED STATES PATENTS

| | | | |
|---|---|---|---|
| 1,494,099 | 5/1924 | Cole | 164/DIG. 2 |
| 1,944,461 | 1/1934 | Pike | 164/66 |
| 1,998,516 | 4/1935 | Monzer | 164/98 |
| 2,066,247 | 12/1936 | Brownback | 164/98 X |
| 2,222,525 | 11/1940 | Zink | 164/80 X |
| 2,234,904 | 3/1941 | Pike | 164/57 X |
| 3,888,295 | 6/1975 | Schillinger | 164/80 X |

*Primary Examiner*—Ronald J. Shore
*Attorney, Agent, or Firm*—Phillips, Moore, Weissenberger, Lempio & Strabala

[57] ABSTRACT

An annular bronze bearing is bonded to a cylindrical inner surface of a metallic member by positioning the member in a fixture to define an annular chamber therein, communicating a charge of bronze alloy particles to the chamber via an open end thereof, melting the alloy and cooling the member and alloy to form the bearing. The apparatus comprises a pair of plates adapted to clamp the metallic member therebetween to define the annular chamber between the member and a cylindrical core. A ceramic funnel is secured on the upper one of the plates to communicate the melted bronze alloy particles to the annular chamber via the open end thereof.

8 Claims, 4 Drawing Figures

(100x)

(500x)

METHOD FOR BONDING A BRONZE BUSHING ON A METALLIC MEMBER

BACKGROUND OF THE INVENTION

Hydraulic pumps and motors of the radial piston type may comprise a rotor which is rotatably mounted on a stationary pintle valve. A typical pump of this type is disclosed in U.S. Patent Application Ser. No. 425,192, filed on Dec. 17, 1973 by William Carl Engel for "High Pressure Radial Piston Fluid Translating Device and Cylinder Construction Therefore", now U.S. Pat. No. 3,878,767. Such application, assigned to the assignee of this application, is adapted to operate at a maximum speed approximating 12,000 rpm with internal fluid pressures reaching levels as high as 7,500 psi.

A conventional sleeve bearing is normally disposed in a bore formed in the rotor to rotatably mount the rotor on a pintle valve. Many such bearings exhibit a relatively short life expectancy due to their separation from the rotor as a result of continued use at high speeds and subjection thereof to high operating pressures in the range mentioned above. Methods and apparatus for forming bearings of this type are disclosed in U.S. Pat. Nos. 3,280,758; 3,707,035; and 3,709.108.

SUMMARY OF THIS INVENTION

An object of this invention is to provide a method and apparatus for economically and expeditiously forming an annular bearing on a cylindrical surface of a metallic member. The method comprises: positioning the member in a fixture to define an annular chamber, open at one end thereof; communicating a charge of bearing alloy to the open end of the chamber in a quantity sufficient to at least substantially fill the chamber; melting the bearing alloy in the chamber; and cooling the metallic member and melted bearing alloy to ambient temperature to bond the bearing to the metallic member. The apparatus comprises a pair of plates adapted to clamp the metallic member therebetween. A funnel is secured to an upper one of the plates to communicate the charge of bearing alloy to the open end of the chamber, defined between the member and a non-metallic core member.

BRIEF DESCRIPTION OF THE DRAWINGS

Other objects and advantages of this invention will become apparent from the following description and accompanying drawings wherein.

DETAILED DESCRIPTION

Figure 1:
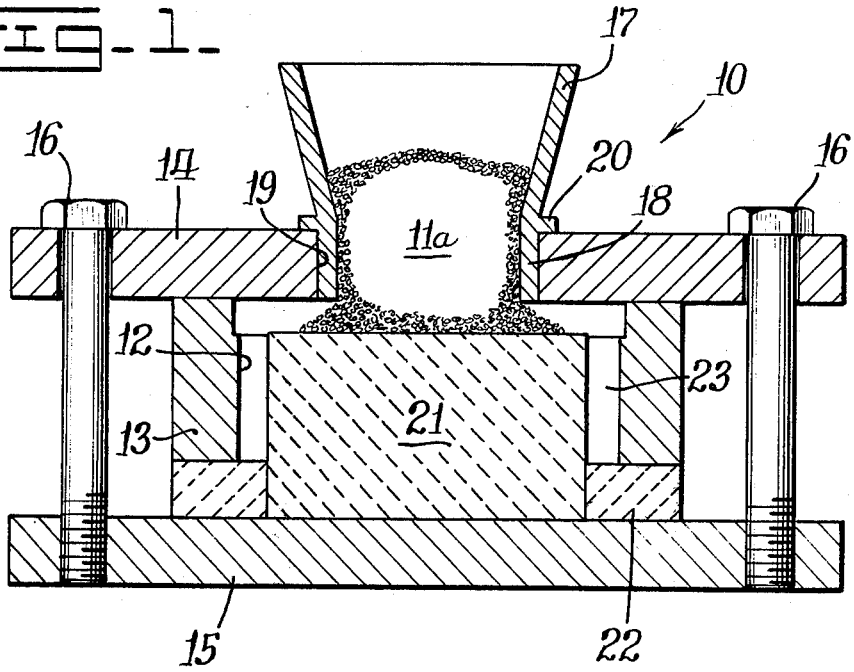
FIG. 1 is a cross sectional view in elevation illustrating an apparatus and method for bonding an annular bearing on a cylindrical inner surface of a metallic member.

FIG. 1 illustrates an apparatus 10 for bonding an annular bronze bearing or bushing 11 (FIG. 2) on a cylindrical inner surface 12 of a cylindrical metallic member 13. The member may be composed of a SAE 4140C steel, for example, adapted to be employed as a rotor in the type of pump disclosed in above-referenced U.S. Pat. Application Ser. No. 425,192. The fixture comprises a pair of circular cover and support plates 14 and 15, respectively, adapted to clamp member 13 therebetween by means of circumferentially disposed bolts 16.

A conically shaped and detachable ceramic funnel means 17 has a lower tubular end 18 thereof disposed in a mating bore 19 formed through the cover plate. An annular flange 20 abuts the upper plate to retain the conically shaped funnel portion of the funnel means in its proper position for feeding particles 11a, constituting bronze bearing 11, into the fixture. A cylindrical non-metallic core 21 is disposed centrally on support plate 15 and has an annular non-metallic graphite support member 22 disposed on the support plate to circumvent the lower end of the core.

Figure 2:
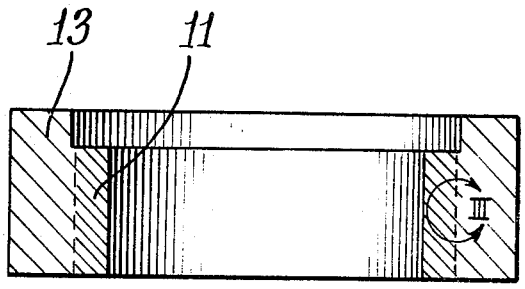
FIG. 2 is a cross sectional view of the metallic member, subsequent to the bonding of a bronze bearing thereon.

Member 13 is supported on member 22 and defines an annular chamber 23 along with core 21, open only at its upper end, adapted to have melted particles 11 *a* communicated thereto to form bearing 11 (FIG. 2). If so desired, the top surface of core 21 could be formed into a conical configuration facing upwardly to aid in guiding particles 11 *a* into chamber 23. Core 21 and support member 22 are each entirely composed of a non-metallic material, such as graphite, (or at least surface coated therewith) to prevent bonding thereof to bearing 11. Also, the fixture could be suitably reconstructed by one skilled in the art to form chamber 23 about the outer cylindrical periphery of member 13 to form bearing 11 thereon.

The method for forming the FIG. 2 rotor will now be described. Prior to assembly of member 13 in the fixture, its inner cylindrical surface 12 is suitably cleaned of oxides, oils and other extraneous matters to induce a sound metallurgical bond thereat. Member 13 is positioned about core 21 and on support member 22 prior to the clamping of cover plate 14 thereon by bolts 16. Subsequent to such clamping, whereby chamber 23 is defined between the core and member 13, a predetermined quantity of bronze alloy 11 *a* is deposited in funnel 17 in a quantity sufficient to completely fill chamber 23.

The loaded fixture is then placed in a suitable furnace (not shown) which preferably provides a non-oxidizing, protective atmosphere, such as 0.40 carbon potential endothermic, exothermic or cracked ammonia atmosphere, to prevent oxidation of cylindrical bonding surface 12. In one application, the member and particles were heated to approximately 1950°F. for 30 minutes to melt the particles for gravity flow from funnel 17 into annular chamber 23. The intimate contact of the molten bronze alloy with surface 12 caused diffusion of the alloy into such surface to form a metallurgical bond therebetween, illustrated by a diffusion band D in FIGS. 3 and 4.

Figure 3:
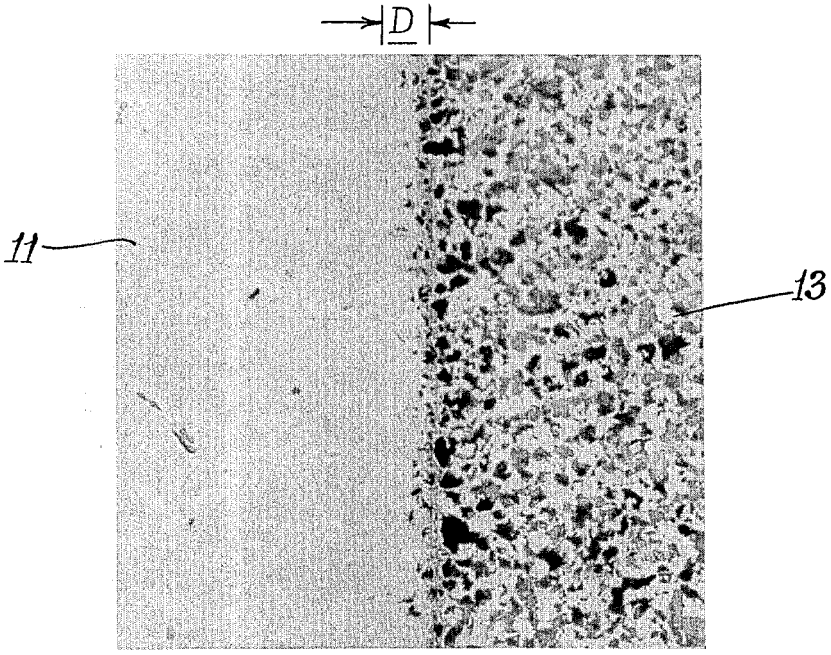
FIG. 3 is a photomicrograph, taken within circle III in FIG. 2 and magnified 100×, illustrating a diffusion band and bond between the metallic member and bronze bearing.
Figure 4:
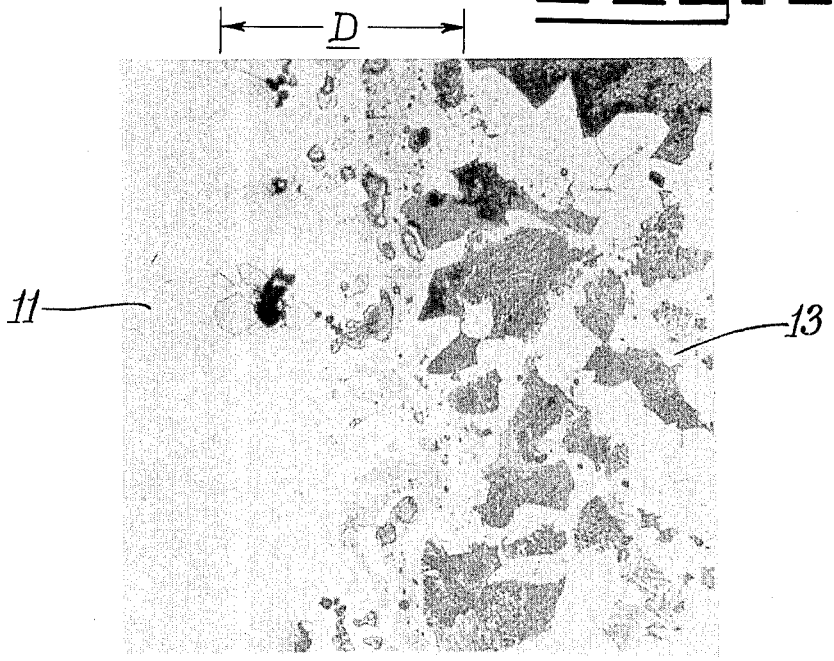
FIG. 4 is a view similar to FIG. 3, but illustrating the diffusion band at a magnification of 500×.

After the heating period has expired, the furnace is allowed to cool to a temperature below approximately 1,500°F. to insure solidification of the bronze alloy and to permit the furnace to be opened without risking an explosion of the protective atmosphere therein. After further cooling to room temperature, bolts 16 are removed to disassemble the fixture to permit removal of the completed FIG. 2 rotor. FIGS. 3 and 4 are photomicrographs illustrating a metallurgical bond between an SAE 4140C steel member 13 and a bronze alloy 11, essentially comprising 90 percent copper and 10 percent tin.

It should be understood that such bearing alloy may comprise a "commercial bronze" or a "genuine bronze," such as the composition mentioned above. For example, such a commercial bronze may comprise a silicone bronze, an aluminum bronze, a manganese bronze or a like composition of the bronze family. However, it is preferable for application of the teachings of this invention to employ a genuine bronze (e.g., 90 percent copper and 10 percent tin) due to the compatability thereof for heat-treating purposes. As shown in FIGS. 3 and 4, in one application diffusion band D had a width approximating 0.0003 to 0.0005 inches and was found to reveal traces of molybedenum and phosphorous therein.

Subsequent to rough machining, the FIG. 2 rotor with its bearing 11 bonded thereto is then heat-treated by heating it to a maximum temperature approximating 1540°F. and thereafter oil-quenched to room temperature. The rotor assembly may be then tempered at 950°F. for approximately 2 to 3 hours to achieve the desired physical characteristics thereof. It has been found that the metallurgical bond at diffusion band D is enhanced during austenitizing by a solid state diffusion reaction occurring during heat treatment. Subsequent thereto, the rotor assembly is final machined and dimensioned to adapt the rotor assembly for installation in a radial piston pump.

We claim:

1. A method for bonding an annular bearing on a cylindrical surface of a metallic member comprising the steps of positioning said metallic member in a fixture to define an annular chamber closed at a first end and open at a second end thereof, placing a charge of a metallic bearing alloy in particle form adjacent to and in communication with the open end of said annular chamber in a predetermined quantity sufficient to at least substantially fill said chamber, melting said bearing alloy and at least substantially filling said annular chamber therewith by gravity flow, and cooling said metallic member and said melted bearing alloy to ambient temperature to form a solidified annular bearing, conforming to the shape of said annular chamber, bonded to said metallic member.

2. The method of claim 1 wherein said placing step comprises the step of funneling particles of a bronze bearing alloy to a position adjacent the open end of said annular chamber.

3. The method of claim 1 wherein said positioning step comprises the step of clamping said metallic member between a pair of plates.

4. The method of claim 1 wherein said positioning step further comprises placing said metallic member in circumventing relationship with respect to an annular non-metallic core to define said annular chamber therebetween.

5. The method of claim 4 wherein said positioning step further comprises the step of defining said annular chamber between an inner cylindrical surface of said metallic member and an outer cylindrical surface of said core.

6. The method of claim 4 wherein said positioning step further comprises mounting said metallic member on an annular non-metallic member defining a closed end of said chamber.

7. The method of claim 1 further comprising the step of subjecting said metallic member to a non-oxidizing, protective atmosphere during melting and bonding of said bearing alloy thereto.

8. The method of claim 1 wherein said melting step comprises subjecting said metallic member and bearing alloy to a temperature approximating at least 1950°F.

* * * * *